US006382455B1

(12) United States Patent
Chen

(10) Patent No.: US 6,382,455 B1
(45) Date of Patent: May 7, 2002

(54) LIQUOR VESSEL AVAILABLE FOR HANGING GOBLETS

(76) Inventor: Li-Hsiu Shih Chen, P.O. Box 90, Tainan City (TW)

( * ) Notice: Subject to any disclaimer, the term of this patent is extended or adjusted under 35 U.S.C. 154(b) by 0 days.

(21) Appl. No.: 09/849,336

(22) Filed: May 7, 2001

(51) Int. Cl.[7] ..... A47G 23/02
(52) U.S. Cl. ..... 220/574
(58) Field of Search ..... 220/574, 574.1, 220/735, 659, 658, 657, 656; D7/603

(56) References Cited

U.S. PATENT DOCUMENTS 269,054 A * 12/1882 Hemsteger ..... 220/574
1,510,710 A * 10/1924 Sperling ..... 220/735
2,970,720 A * 2/1961 Dooley, Jr. ..... 220/735
5,361,932 A * 11/1994 Friedrich ..... 220/574
5,392,948 A * 2/1995 McEntee ..... 220/574
6,021,914 A * 2/2000 Schmidt ..... 220/574

* cited by examiner

*Primary Examiner*—Stephen Castellano

(57) ABSTRACT

The liquor vessel. The vessel can be used to hang goblets. The vessel has a vessel body and a flaring flange formed protruding outwardly and upwardly from an upper opening. The flaring flange includes hang grooves that are provided spaced apart and equidistantly. Each groove includes an outer narrow portion and a wide inner curved portion for hanging a goblet conveniently and steadily therein.

2 Claims, 2 Drawing Sheets

LIQUOR VESSEL AVAILABLE FOR HANGING GOBLETS

BACKGROUND OF THE INVENTION

1. Field of the Invention

This invention relates to a liquor vessel available for hanging up goblets, particularly to one having a flaring flange formed protruding outward and upward from an upper opening and provided with plural hang grooves spaced apart equidistantly, each hang groove having a narrow outer portion and a wide inner curved portion for a goblet to fit and hang steadily therein, not only facilitating fetching and using goblets, but saving space for placing them as well.

2. Description of the Prior Art

A known conventional liquor vessel is used for nothing but icing liquor bottles. In case of using, the liquor goblets have to be fetched down first from a shelf and then placed on a tray for filling in liquor, thus troublesome in fetching and using goblets, which require large space for placing them and also are liable to be broken due to carelessness.

SUMMARY OF THE INVENTION

The objective of the invention is to offer a liquor vessel available for hanging up goblets.

The feature of the invention is a liquor vessel formed with a flaring flange around an upper opening, the flaring flange having plural hang grooves provided spaced apart equidistantly, with each hang groove formed to have an outer narrow portion and an inner curved portion for hanging each goblet therein steadily.

BRIEF DESCRIPTION OF THE INVENTION

Figure 1:
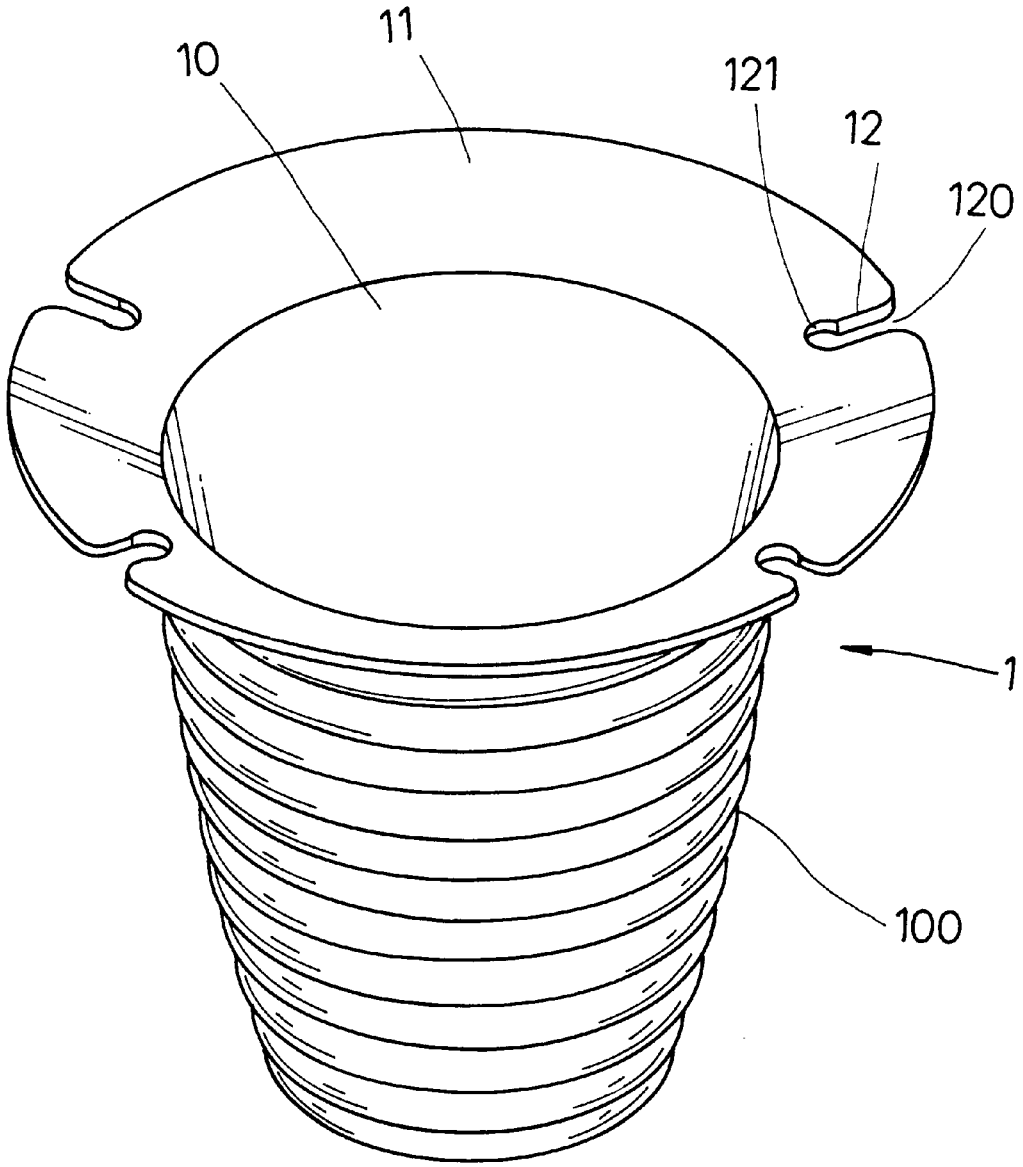
Figure 2:
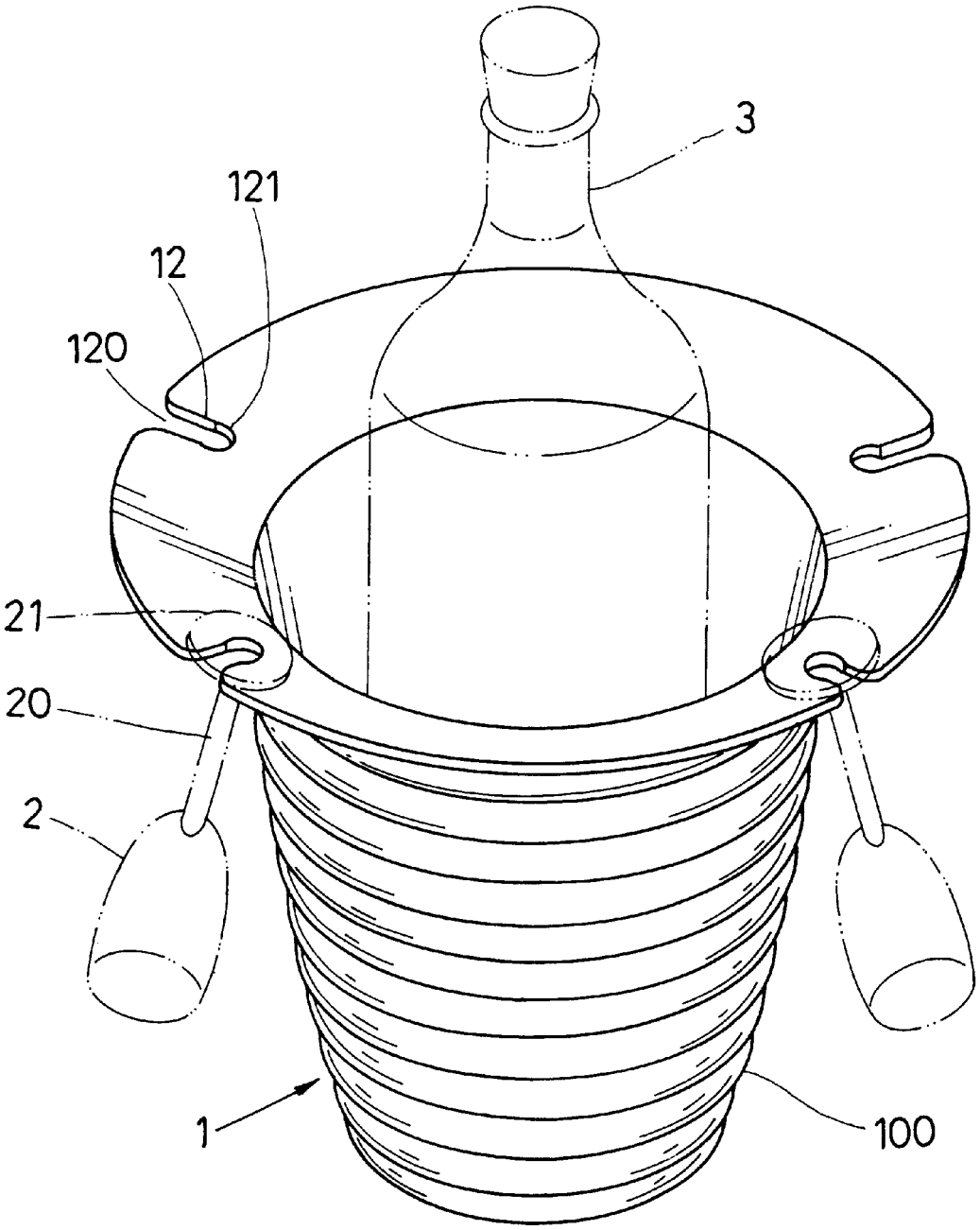

This invention will be better understood by referring to the accompanying drawings, wherein:

FIG. 1 is a perspective view of a liquor vessel in the present invention; and, FIG. 2 is a perspective view of the liquor vessel in using condition in the present invention.

DETAILED DESCRIPTION OF THE PREFERRED EMBODIMENT

A preferred embodiment of a liquor vessel 1 in the present invention, as shown in FIGS. 1 and 2, has an upper opening 10, an annular flaring flange 11 formed around the opening 10. Then, a plurality of hang grooves 12 are provided spaced apart equidistantly in the flaring flange 11, and each groove 12 is formed to have an outer narrow portion 120 and a wide inner curved portion 121.

Therefore, it is convenient to hang up a goblet upside down in each groove 12, with the foot of each goblet being inserted through the V-shaped outer narrow portion 120 into the wide inner curved portion 121 of each groove 12 with a disk-shaped bottom 21 of the goblet's elongated foot 20 resting on the annular edge of the inner wide curved portion 121. Thus, the flaring flange 11 will steadily support the bottoms of the goblets 2 to prevent them from swinging about or slipping off, as shown in FIG. 2. And besides, the vessel body 100 of the vessel 1 itself receives a liquor bottle 3 to be iced inside.

To sum up, the liquor vessel of this invention has some advantages described below.

1. The liquor vessel is available not only for hanging up goblets but for receiving liquor bottles to be iced as well, acquiring preferable practicability and facility.

2. It is possible to get rid of troublesome fetching of goblets on a shelf and then placing them on a tray for delivering.

3. It is convenient to fetch the goblets down from or hang them up on the flaring flange of the liquor vessel and possible to save space for placing them.

While the preferred embodiment of the invention has been described above, it will be recognized and understood that various modifications may be made therein and the appended claims are intended to cover all such modifications that may fall within the spirit and scope of the invention.

What is claimed is:

1. A liquor vessel comprising:

a vessel body, the vessel body comprising an open container with a closed bottom and a top opening;

an annular flaring flange extending annularly outwards from the top opening of the vessel body, the annular flaring flange comprising inner and outer circumferences;

at least two hang grooves equidistantly spaced apart extending from the outer circumference of the annular flaring flange, each of the hang grooves extending towards the inner circumference of the annular flaring flange, each of the hang grooves comprising a V-shaped outer narrow portion, the width of the outer narrow portion becoming narrower as the outer narrow portion extends from the outer circumference of the annular flaring flange towards the inner circumference of the annular flaring flange, each of the hang grooves further comprising a wide inner curved portion which is circularly shaped at the narrower portion of each of the outer narrow portions; and each of the hang grooves adapted to receive an inverted goblet which can be hung on the annular flaring flange, and the vessel body is adapted to receive a liquor bottle and ice.

2. The liquor vessel as claimed in claim 1, wherein first corners at which the wide inner curved portions and the outer narrow portions meet are rounded, and second corners at which the outer narrow portions and the outer circumference of the annular flaring flange meet are rounded.

* * * * *